United States Patent [19]

Komiya et al.

[11] Patent Number: 4,697,916

[45] Date of Patent: Oct. 6, 1987

[54] IMAGE FORMING APPARATUS

[75] Inventors: Yutaka Komiya, Tokyo; Masahiro Tomosada, Kawasaki; Shinichi Nakamura, Tokyo; Masanori Miyata; Masayuki Hirose, both of Yokohama; Hideki Adachi, Kawasaki, all of Japan

[73] Assignee: Canon Kabushiki Kaisha, Tokyo, Japan

[21] Appl. No.: 870,907

[22] Filed: Jun. 5, 1986

Related U.S. Application Data

[63] Continuation of Ser. No. 772,164, Sep. 3, 1985, abandoned, which is a continuation of Ser. No. 532,143, Sep. 14, 1983, abandoned.

[30] Foreign Application Priority Data

Sep. 25, 1982 [JP] Japan ..... 57-165991
Sep. 25, 1982 [JP] Japan ..... 57-165992

[51] Int. Cl.[4] ..... G03G 15/00

[52] U.S. Cl. ..... 355/14 E; 355/3 CH; 355/14 CH

[58] Field of Search ..... 355/3 R, 14 R, 55, 14 E, 355/56, 7

[56] References Cited

U.S. PATENT DOCUMENTS

| | | | |
|---|---|---|---|
| 3,685,894 | 8/1972 | Lux et al. | 355/3 |
| 3,834,807 | 9/1974 | Fuller et al. | 355/3 R |
| 4,046,467 | 9/1977 | Laskowski et al. | 355/3 R |
| 4,255,042 | 3/1981 | Armitage et al. | 355/3 R |
| 4,291,643 | 9/1981 | Kobayashi et al. | 355/10 X |
| 4,334,763 | 6/1982 | Honda et al. | 355/67 X |
| 4,344,691 | 8/1982 | Grant et al. | 355/1 |
| 4,435,064 | 3/1984 | Tsukada et al. | 355/1 |

FOREIGN PATENT DOCUMENTS

| | | |
|---|---|---|
| 2361670 | 8/1979 | Fed. Rep. of Germany . |
| 2900366 | 12/1979 | Fed. Rep. of Germany . |
| 54-136333 | 10/1979 | Japan . |
| 2011647 | 12/1977 | United Kingdom . |

*Primary Examiner*—A. C. Prescott

*Attorney, Agent, or Firm*—Fitzpatrick, Cella, Harper & Scinto

[57] ABSTRACT

An image forming apparatus comprises latent image forming means for forming a latent image on a photosensitive medium, reference latent image forming means for forming a reference latent image adjacent to the latent image, a plurality of light-emitting means disposed at intervals of a pitch D equal to or smaller than the width l of the reference latent image, and means for drivingly controlling the plurality of light-emitting means in accordance with the size of the latent image.

9 Claims, 10 Drawing Figures

IMAGE FORMING APPARATUS

This is a continuation of application Ser. No. 772,164, filed Sept. 3, 1985, which in turn is a continuation of Ser. No. 532,143, filed Sept. 14, 1983, both now abandoned.

BACKGROUND OF THE INVENTION

1. Field of the Invention

This invention relates to an image forming apparatus, and more particularly to an image forming apparatus in which adherence of to excess toner to a photosensitive medium is prevented.

2. Description of the Prior Art

Heretofore, in a copying apparatus having the magnification changing function, the process of preventing toner from adhering to a non-image area (the black-erasing process) during stepped magnification change could be accomplished by various means disposed in the direction of rotation of the drum, but aligned in a direction parallel to the axis of the drum. Such process has usually been accomplished by placing a tiny lamp adjacent the drum and turning the lamp on and off in accordance with a selected magnification factor. In the case of continuous magnification change, however, it has been necessary to turn the lamp on and off continuously, and with the conventional tiny lamp, it has been impossible to effect this function because of the pitch involved. Also, means comprising a plurality of light-emitting elements such as LEDs (light-emitting diodes) has been proposed, but such means has not been usable due to the deficiency of quantity of light because, in a copying apparatus using the NP process, light must be applied from behind a charger for simultaneous exposure and discharging and because the optical path of the referred light from an original must not be intercepted. There has been a further problem that such process cannot be effected in continuous magnification changes below the pitch interval of LEDs. Also, means have been proposed whereby a movable shielding member disposed in front of the lamp is continuously moved in accordance with a magnification factor to continuously intercept the light of the lamp, but such means have not yet been realized because the image on the photosensitive medium is adversely affected by diffraction or irregular reflection of light and because there occurs a problem such as complexity of the construction. Ideally, however, elements which are very small point sources of light and whose lights do not diverge and which are arranged at a very small pitch would be useful, but such ideal elements have not yet been provided.

SUMMARY OF THE INVENTION

It is an object of the present invention to eliminate the above-noted disadvantages.

It is another object of the present invention to provide an image forming apparatus in which waste of toner is prevented.

It is still another object of the present invention to provide an image forming apparatus which enables reproduced images of high quality to be obtained.

It is yet another object of the present invention which enables excellent reproduced images to be obtained by a simple construction.

It is a further object of the present invention to provide an image forming apparatus which minimizes the toner consumption for all originals during continuous magnification change and which enables the making of attractive copies with very few toner stains.

It is still a further object of the present invention to provide an image forming apparatus which effectively uses an LED array or the like to reduce power consumption and heat generation and which is simple in construction and inexpensive.

Other objects of the present invention will become apparent from the following detailed description taken in conjunction with the accompanying drawings and the appended claims.

DESCRIPTION OF THE PREFERRED EMBODIMENTS

The present invention will hereinafter be described in detail by reference to the drawings.

Figure 1:
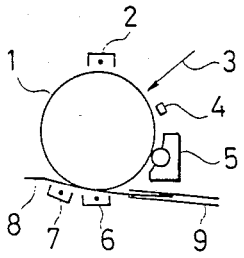
FIG. 1 schematically illustrates an example of the interior construction of a Carlson process type copying apparatus to which the present invention is applied.

FIG. 1 schematically shows an example of the construction of the essential portions of a Carlson process type copying apparatus to which the present invention is applied. A photosensitive medium 1 on a drum is uniformly charged by a charger 2, whereafter it is exposed to a reflected light 3 from an original (not shown) to thereby form a latent image thereon. The latent image is developed by a developing device 5. On the other hand, copy paper (recording paper) 8 is fed so that it is coincident with the developed visible image at a transfer station, and the developed image is transferred to the copy paper 8 by a transfer charger 6, whereafter the copy paper 8 is electrically discharged by a charger 7 and separated from the drum. Designated by 4 is the essential portion of the present invention which is a black-erasing LED array for a non-image area which will later be described.

Figure 2:
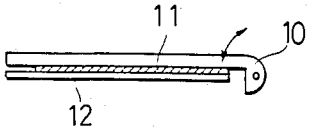
FIG. 2 is a front view showing an example of the construction of the original supporting table of the FIG. 1 copying apparatus.
Figure 3A:
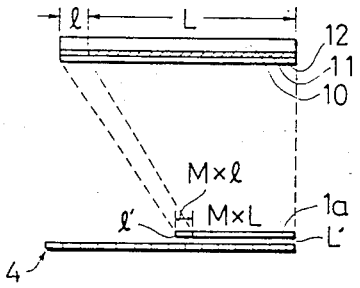
FIGS. 3A and 3B respectively are a front view showing the relation between the original of FIG. 2 and the latent image on a photosensitive drum and a view showing the latent image on the photosensitive drum.
Figure 3B:
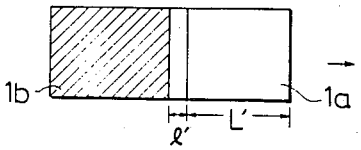

FIG. 2 shows an example of the construction of the original supporting table of the copying apparatus of FIG. 1. First, an original 11 to be copied is placed on an original supporting glass 12, and then a pressure plate 10 is lowered. The entire back surface of the pressure plate 10 is white. When copying is effected at a magnification factor M with the pressure plate 10 lowered, the image of the original 11 having a length L is magnification-changed to a length $M \times L$ and formed as a latent image on the photosensitive drum 1, as shown in FIGS. 3A and 3B.

The latent image area of the original on the photosensitive drum 1 is indicated by L'. This latent image area L' is varied by a magnification factor, which may be designated, for example, by the user using a ten-key pad or the like on an operating portion, not shown. When the magnification factor is designated and a start key, not shown, is depressed, an optical system, not shown, is moved in accordance with that magnification factor and the speed of a scanner, not shown, which scans the original is changed over and a latent image of the original is formed on the photosensitive medium at a desired magnification factor. The pressure plate 10 is provided so that its length is greater by l than the length of the original and the white back surface portion of the length l remains and therefore, a white reference latent image area l' having a dimension corresponding to a length M×l is formed on the photosensitive drum 1 adjacent to the end of an area L'. Reference character 1*a* designates the latent image by the reflected light 3 formed on the photosensitive drum 1, and a portion 1*b* indicated by hatching shows a dark latent image formed on the photosensitive drum 1. The arrow in FIG. 3B indicates the axial direction of the drum. If magnification change is continuously effected when the white reference latent image l' by the pressure plate 10 is absent, the borderline between the dark latent image 1*b* and the latent image L' of the original is continuously varied and thus, light must be continuously applied to the dark portion which must be erased. In the present embodiment, however, the design is made such that the white latent image area l' is present during magnification change and therefore, L' is an area to which light must not be applied, l' is an area to which light may or may not be applied and the portion 1*b* indicated by hatching is an area to which light must be applied. Therefore, design can be made such that if the light emitted from the LED array 4 arranged at a pitch D (see FIG. 5) smaller than or equal to l' is suitably applied in accordance with the magnification factor M, at least the portion 1*b* indicated by hatching is irradiated without fail and the area L' is never irradiated. The pitch D may be based on the l' when the original is reduced to the smallest size.

Figure 4A:
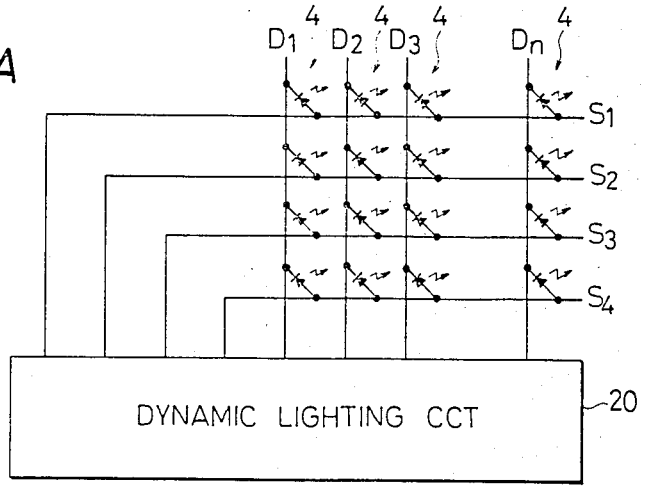
FIGS. 4A and 4B respectively are a circuit diagram showing an example of the construction of the light control circuit of the copying apparatus of FIG. 1 and a detailed view of an LED array.
Figure 4B:
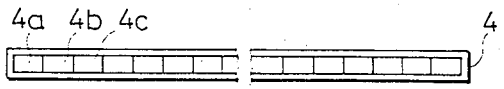

FIGS. 4A and 4B respectively are a schematic construction view of the light control circuit of the copying apparatus of FIG. 1 and a detailed view of the LED array 4. The elements 4*a*, 4*b*, . . . of the LED array 4 are connected as the points of intersection between the matrices of digit lines $D_1$–$D_n$ and scan lines $S_1$, $S_2$, . . . , and the LED elements selected on the basis of the magnification change factor are dynamically turned on by a dynamic lighting circuit 20.

Figure 5:
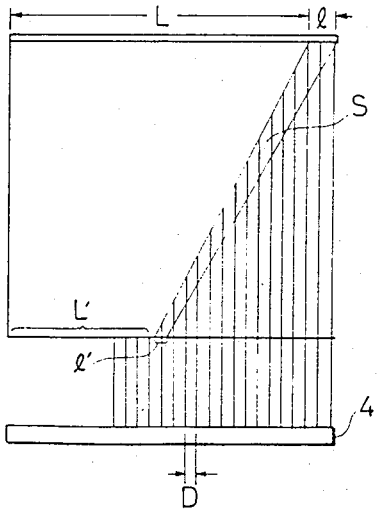
FIG. 5 illustrates the relation between the LED array of FIG. 4 and magnification factor.

FIG. 5 shows the relation between the magnification factor and the operation of the elements of the LED array 4 of FIG. 4. In FIG. 5, a portion designated by S is an area which may or may not be electrically discharged, and each element of the LED array 4 is turn-on-controlled so that the latent image of the original is not spoiled in such a manner that at least all of the area on the right-hand side of the area S is electrically discharged and that at least all of the area on the left-hand side of the area S is not electrically discharged.

Description will now be made of an example of the case where the present invention is used in an NP process type copying apparatus.

Figure 6A:
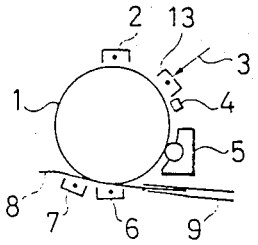
FIGS. 6A and 6B respectively are a schematic illustration showing an example of the interior construction of an NP process type copying apparatus to which the present invention is applied and a graph showing the process thereof.
Figure 6B:
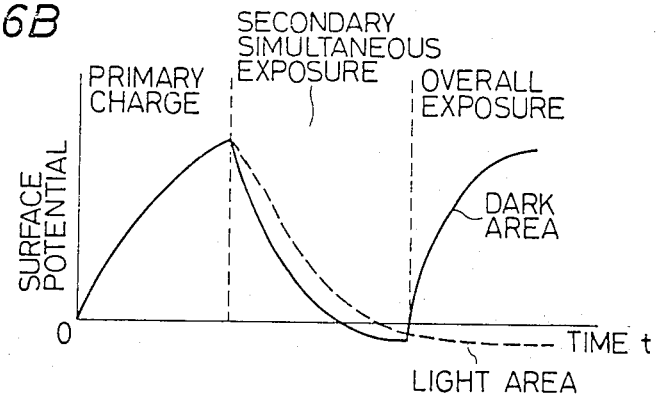

FIG. 6A schematically shows an example of the construction of the essential portions of an NP process type copying apparatus to which the present invention is applied. Members functionally similar to those of FIG. 1 are given similar reference numerals. A drum-shaped photosensitive medium 1 is uniformly charged by a charger 2. Thereafter, the reflected light from an original (not shown) is applied to the photosensitive medium 1 as it is charged to the opposite polarity by a charger 13, whereby a latent image is formed on the photosensitive medium 1, and then a developable potential (a final electrostatic latent image) is formed by the overall exposure of LED array 4. The above-described process is as shown in FIG. 6B and is a well-known theory and therefore, the details thereof need not be described. The latent image is soon developed by a developing device 5. On the other hand, copy paper (recording paper) 8 is fed along a conveyance path 9 so that it is coincident with the developed visible image at a transfer station, and the developed image is transferred to the copy paper 8 by a transfer charger 6, and then the copy paper 8 is electrically discharged by a charger 7 and separated from the photosensitive medium 1. The element of the LED array 4 which has been selected and turned on is used as an overall exposure lamp and the element of the LED array 4 which has not been turned on functions also as a black-erasing element for a non-image area.

As described in connection with FIGS. 2 and 3, when copying is effected at a magnification factor M, the image of the original 11 having a length L is magnification-changed to a length M×L and is formed as a latent image on the photosensitive drum 1. The length of the pressure plate is greater by l than the length of the original and therefore, a white latent image area l' having a dimension corresponding to a length M×l is formed on the photosensitive drum 1 adjacent to the end of an area L'. In FIG. 3, reference character 1*a* designates the latent image by the reflected light 3 formed on the photosensitive drum 1, and a portion 1*b* indicated by hatching shows a dark latent image formed on the photosensitive drum 1. If magnification change is continuously effected when the white latent image l' by the pressure plate 10 is absent, the borderline between the dark latent image 1*b* and the latent image L' of the original is varied and thus, light must be continuously applied only to the latent image L'. In the present embodiment, however, design is made such that a white latent image l' is present during magnification change and therefore, L' is an area to which light must be applied, l' is an area to which light may or may not be applied, and the portion 1*b* indicated by hatching is an area to which light must not be applied and thus, design can be made such that if the light emitted from the LED array 4 arranged at a pitch D (see FIG. 5) smaller than or equal to l' is suitably applied, at least the portion 1*b* indicated by hatching is never irradiated but the area L' is positively irradiated.

As a result, as shown in FIG. 6B, in a portion wherein overall exposure is not effected, a potential to be developed does not appear on the surface of the drum 1 in spite of a latent image being formed. That is, the portion in which overall exposure is not effected is the same in that even the potential of the dark area 1*b* is a potential which is not developed, like the potential of the light area.

Again in this embodiment, the turn-on control of each element of the LED array 4 can be effected on the basis of a magnification factor by the use of the circuit described in connection with FIG. 4. Also, for example, when a magnification factor is designated by a ten-key pad, not shown, the dynamic lighting circuit 20 selects the digit line in accordance with that magnification factor each time scanning of each scan line $S_1$, $S_2$, . . . is effected, and turns on each light-emitting element.

The present embodiment will hereinafter be described by reference to FIG. 5. The portion indicated by S is an area to which light may or may not be applied, and each element of the LED array 4 is turn-on-controlled so that the latent image of the original is not spoiled in such a manner that at least all of the area on the right-hand side of the area S is not irradiated and that at least all of the area on the left-hand side of the area S is irradiated.

According to the present invention, as described above, a white latent image is created in a portion which has been made into a non-image area by continuous magnification change and therefore, even during continuous magnification change, excess toner is not wasted and excess toner does not adhere and thus, clean copies can be obtained. Further, according to the present invention, the LED array can be used effectively, and this leads to low power consumption and low heat generation as well as inexpensiveness and high reliability of the apparatus. Also, if, as in the present embodiment, the so-called dynamic lighting system is used for driving of the LED array, the driving circuit thereof becomes simpler and it becomes possible to further reduce the power consumption and the heat generation.

Figure 7:
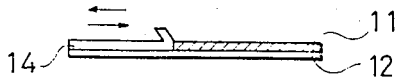
FIG. 7 is a schematic view of a slide plate having a white back surface.

Although the present embodiment has been shown with respect to the case of the one side standard, the present invention is also suitable in a case where the standard is in the middle. Also, in the present embodiment, control means using an LED array has been shown, but a similar effect can also be obtained in a case where an LCD shutter array is used. Further, in the present embodiment, the area to which light may or may not be applied is formed by means of the pressure plate, but such area may also be formed by causing a slide plate 14 having a white back surface to slide in conformity to the end of the original as shown in FIG. 7.

Also, in the present embodiment, a white latent image of a predetermined width is formed adjacent to the latent image of the original by the use of a pressure plate having a white back surface, whereas the present invention is not restricted thereto, but any other pressure plate which can form a reference latent image of a predetermined width adjacent to the latent image of the original may be used.

Also, in the present embodiment, description has been made of the prevention of toner adherence during continuous magnification change, but the present invention can also be used in another mode, for example, when the size of the original changes continuously. That is, adherence of excess toner can be prevented if the original size detecting means or a manually operated input means is provided so as to ensure a reference latent image of a predetermined width to be formed adjacent to the latent image of the original and the LED array is turn-on-controlled in accordance with the designated original size.

In the present embodiment, when an original of a definite size is placed at the reference position, a white latent image of a predetermined width is formed adjacent to the latent image of the original and the LED array is turn-on-controlled in accordance with a magnification factor. The design may also be made such that a white latent image of at least said predetermined width can always be formed adjacent to the latent image of the original even if the position at which the original is placed is changed, and means for detecting the position of the original may be provided to select the element of the LED array to be turned on in accordance with the position at which the original has been placed and the magnification factor.

As a result, adherence of excess toner can be prevented even if the position at which the original is placed and the magnification factor are changed.

Also, in the present embodiment, the black-erasing process is effected with respect to a direction parallel to the axis of the drum, but the black-erasing process in the direction of rotation of the drum can also be effected by turning on all of the elements of the LED array at predetermined timing.

The turn-on-control of the LED array in the present embodiment can be accomplished, for example, by the command signal from a CPu (microcomputer), not shown. That is, when a magnification factor is designated, the CPu puts out a command signal, corresponding to that magnification factor, to the lighting circuit 20 and instructs which element should be turned on. Alternatively, selection of the element may be effected in accordance with a magnification factor without the CPu being used.

The present invention is not restricted to the above-described embodiments, but various modifications may be made therein without departing from the scope of the invention as defined in the appended claims.

We claim:

1. An image forming apparatus comprising:

latent image forming means for forming a latent image corresponding to an original on a photosensitive medium, wherein the size of said latent image is varied continuously in accordance with selected magnification;

reference latent image forming means for forming a reference latent image which is not to be developed, adjacent to said latent image, said reference latent image having a width dimension formed in accordance with the selected magnification;

a plurality of light-emitting means disposed at intervals of a pitch equal to or smaller than the width dimension of said reference latent image as determined by a selected minimum magnification;

means for controlling said plurality of light-emitting means in accordance with the size of said latent image of the original.

2. An image forming apparatus according to claim 1, wherein said plurality of light-emitting means are an LED array.

3. An image forming apparatus according to claim 1, wherein said reference latent image forming means forms a white latent image adjacent to the latent image of an original whose size is variable in accordance with magnification factor.

4. An image forming apparatus according to claim 1, wherein said reference latent image forming means includes an original pressure plate having a white back surface.

5. An image forming apparatus comprising:

latent image forming means for forming a latent image corresponding to an original on a photosensitive medium, wherein the size of said latent image is varied continuously in accordance with a selected magnification;

reference latent image forming means for forming a reference latent image which is not to be developed, adjacent to said latent image, said reference latent image having a width dimension formed in accordance with the selected magnification;

a plurality of light-emitting means each having a width which is in a predetermined relation with the width dimension of said reference latent image as determined by a selected minimum magnification; and means for controlling said plurality of light-emitting means in accordance with the size of said latent image of the original.

6. An image forming apparatus according to claim 5, wherein each of said plurality of light-emitting means is of a width equal to or smaller than the width dimension of said reference latent image determined by said selected minimum magnification.

7. An image forming apparatus according to claim 6, wherein said plurality of light-emitting means are an LED array.

8. An image forming apparatus according to claim 5, wherein said reference latent image forming means includes an original pressure plate having a white back surface.

9. An image forming apparatus according to claim 5, wherein said reference latent image forming means forms a white latent image adjacent to the latent image of an original whose size is variable in accordance with a magnification factor.

* * * * *